US005251419A

United States Patent [19]

Ohtsuka

[11] Patent Number: 5,251,419

[45] Date of Patent: Oct. 12, 1993

[54] STONE-PAVED FLOOR CONSTRUCTION, AND METHOD OF PAVING FLOOR WITH STONE

[75] Inventor: Nobuhiko Ohtsuka, Gunma, Japan

[73] Assignee: Incorporated Company Ohtsuka, Gunma, Japan

[21] Appl. No.: 950,325

[22] Filed: Sep. 24, 1992

[51] Int. Cl.[5] ..... E04B 5/14

[52] U.S. Cl. ..... 52/477; 52/664; 52/747; 404/35

[58] Field of Search ..... 52/664, 667, 472, 488, 52/747; 404/35, 36, 37, 34

[56] References Cited

U.S. PATENT DOCUMENTS

| | | | |
|---|---|---|---|
| 368,398 | 8/1887 | Hoyt | 52/477 |
| 3,025,772 | 3/1962 | Palatini | 52/477 |
| 4,543,759 | 10/1985 | Rohrer | 52/667 |

*Primary Examiner*—Carl D. Friedman
*Assistant Examiner*—Christopher T. Kent
*Attorney, Agent, or Firm*—Townsend, Snider & Banta

[57] ABSTRACT

A method and apparatus is provided for forming a stone-paved floor. A flexible frame structure is formed from a plurality of connector bars linked to one another through pivotable joints at the ends thereof. Connector bars are coupled in a crossed configuration at center portions thereof to form a plurality of enclosures into which paving stones are fitted.

6 Claims, 4 Drawing Sheets

STONE-PAVED FLOOR CONSTRUCTION, AND METHOD OF PAVING FLOOR WITH STONE

BACKGROUND OF THE INVENTION

1. FIELD OF THE INVENTION

This invention relates to a stone-paved floor construction suitable for installation on floor surfaces of housings in general, concrete buildings for hotels or the like and brick buildings, and at the same time to a method of paving floor surfaces with stones. More particularly, this invention concerns a stone-paved floor construction and a floor paving method, which do not require mason's meticulous skills or which can make up for a lack of meticulous skills on the part of masons, for laying paving stones promptly and neatly while achieving improvements in working efficiency, and as a consequence reduction in the costs of construction.

2. DESCRIPTION OF THE PRIOR ART

Along with the recent development of nuclear facilities and industrial developments, there has been a sharp increase in construction of housing and buildings for hotels and the like. This has been particularly conspicuous in metropolitan areas.

The floor surfaces of such housing in general, concrete buildings for hotels and brick buildings are often paved with a material such as ceramic or asphalt plastic tiles or pieces of natural stone like marble or the like to provide a pleasing appearance.

Heretofore, manual labors when paving a floor surface have usually resorted to laying tiles or marble of substantially thin square shape on the floor surface immediately after concrete placement. The laid tiles or marble stones are then tapped with a rubber hammer or the like to ensure intimate contact with the underlying floor surface.

In the case of resurfacing a paved floor, it has been the usual practice to break the paved titles or marble stone into pieces by the use of a crushing machine or the like, and then lay new tiles or marble stone again on the floor surface in the above-described manner.

The above-described conventional floor paving method has involved a number of problems or drawbacks as follows.

When paving ceramic or asphalt plastic tiles or marble stones on floor surfaces in houses in general, concrete buildings or hotel or the like or brick buildings, difficulties are often encountered in laying the respective paving material units of a square or similar shape neatly in intimate contact with side surfaces of adjacent paving material units. This is because the individual paving material units usually differ from each other in longitudinal or transverse dimension, and cannot be neatly set in position simply by placing them in abutting contact with adjacent paving material units. This results in a degradation in the aesthetic appearance of the floor.

Further, the paving material placed on the adjacent floor is tapped with a rubber hammer as mentioned above to transmit vibrations to the underlying concrete. This is to urge same into intimate contact with the laid paving material and to ensuring that the paving material is bonded securely to the concrete when the latter cures and solidifies. The number of times of hammering, as well as the magnitude of hammering on such a occasion requires so-called "workmanship" based on long experience. This job is extremely difficult for an inexperienced worker.

Inappropriate hammering by an unexperienced worker can result in a problem of an incomplete bond between the underlying concrete and the paving material, and, consequently, in loosening or defoliation of the paved material.

Further, the stone-paved floor which requires a very high level of skill as mentioned above, is extremely difficult not only for an inexperienced worker but also for an experienced worker like a mason, in addition to a drawback of requiring a great deal of time.

On the other hand, when resurfacing a worn-out paved floor surface according to conventional methods, the floor surface can be paved with new paving material only after removal of oil paving material as mentioned hereinbefore, despite marked increases in paving cost and time.

In the case of conventional stone-paved floor, when one piece of the paving material, which is fixedly bonded on the floor surface closely to other pieces, is broken, the whole floor surface has to be re-paved since it is extremely difficult to replace one broken piece alone.

Further, in case of conventional methods, for laying various patterns on floor surfaces using tiles or marble stone pieces of different colors, the paving worker must have artistic talents.

Currently the population of craftsmen is on the decrease as a result of changes in social structure under the influence of technological developments, including introduction or application of industrial robots or other sophisticated machines. The masons who carry out the floor paving work are not an exception in this regard, and the question of how to cope with the lack of masons has become a matter of great concern in the construction industry.

In connection with the floor pavement with tiles or marble stone, it has been known in the art to install a floor heater in a paved floor. However, such floor heaters have been suffering from a problem of inefficient heating effect since in most cases they are arranged to transmit heat to the paving material at the floor surface through mortar.

In view of the foregoing problems, the present invention contemplates providing a stone-paved floor construction and a floor paving method, which can be put into practice without meticulous skills, and which makes up for the lack of skilled workers like masons, while making it possible for the unskilled worker to carry out the construction of pavement promptly and neatly to achieve improvements in working efficiency and the reduction in construction costs.

SUMMARY OF THE INVENTION

In accordance with the present invention, the above-stated objectives are achieved by a stone-paved floor construction which is characterized by the provision of: a plural number of connector bars linked one to another through pivotable joints to form a flexible frame structure; and paving stones fitted in enclosures defined by the connector bars to form a stone-paved floor surface.

In accordance with the present invention, the above-stated objectives are also achieved by the provision of a method of paving a floor with stones, characterized by: coupling connector bars in a crossed configuration at center portions thereof; linking the connector bars one to another through pivotable joints to form a frame structure substantially in a reticulated shape; installing the frame structure on a floor surface; and fitting paving stones in the enclosures.

The stone-paved floor construction and the floor paving method according to the present invention permits even inexperienced workers to pave floors neatly in a prompt manner, so that it is possible to improve the working efficiency and to reduce the working cost, thus solving the problem of the lack of skilled workers like masons.

According to the present invention, a plurality of connector bars are coupled in crossed state and linked to each other pivotally at their opposite end portions by the use of screws or the like to form a flexible frame structure of a reticulated shape containing a number of openings (enclosures) to receive paving material therein. A floor surface can be reformed simply by placing the frame structure on an existing floor surface.

Instead of an integrated singular structure, the above-mentioned frame structure according to the present invention is constituted by a plurality of connector bars which are pivotally linked to each other as mentioned above. Therefore, when the frame structure is placed on a floor surface with irregularities in surface level (a floor surface is not a perfectly flat surface and always contains a certain degree of irregularities), the respective connector bars function to absorb such surface irregularities.

When the frame structure is placed on a floor surface, the respective connector bars are flexed relative to each other according to the degree of surface irregularities and brought into abutting engagement with the floor surface to prevent the frame structure from loosely floating above the floor surface.

The frame structure which has the above-described construction can be coiled into a roll by flexing the respective connector bars at the joint portions. Accordingly, an assembled frame structure can be easily transported.

The paving stone can be easily fitted into the enclosures, and, once fitted in position, the screws at the joint portions function to support the paving stone resiliently in such a manner as to absorb small dimensional errors in the individual pieces of the paving stone units.

Hereafter, the stone-paved floor construction and the floor paving method according to the invention will be described in greater detail by way of preferred embodiments with reference to the accompanying drawings.

DESCRIPTION OF THE PREFERRED EMBODIMENT

Figure 1:
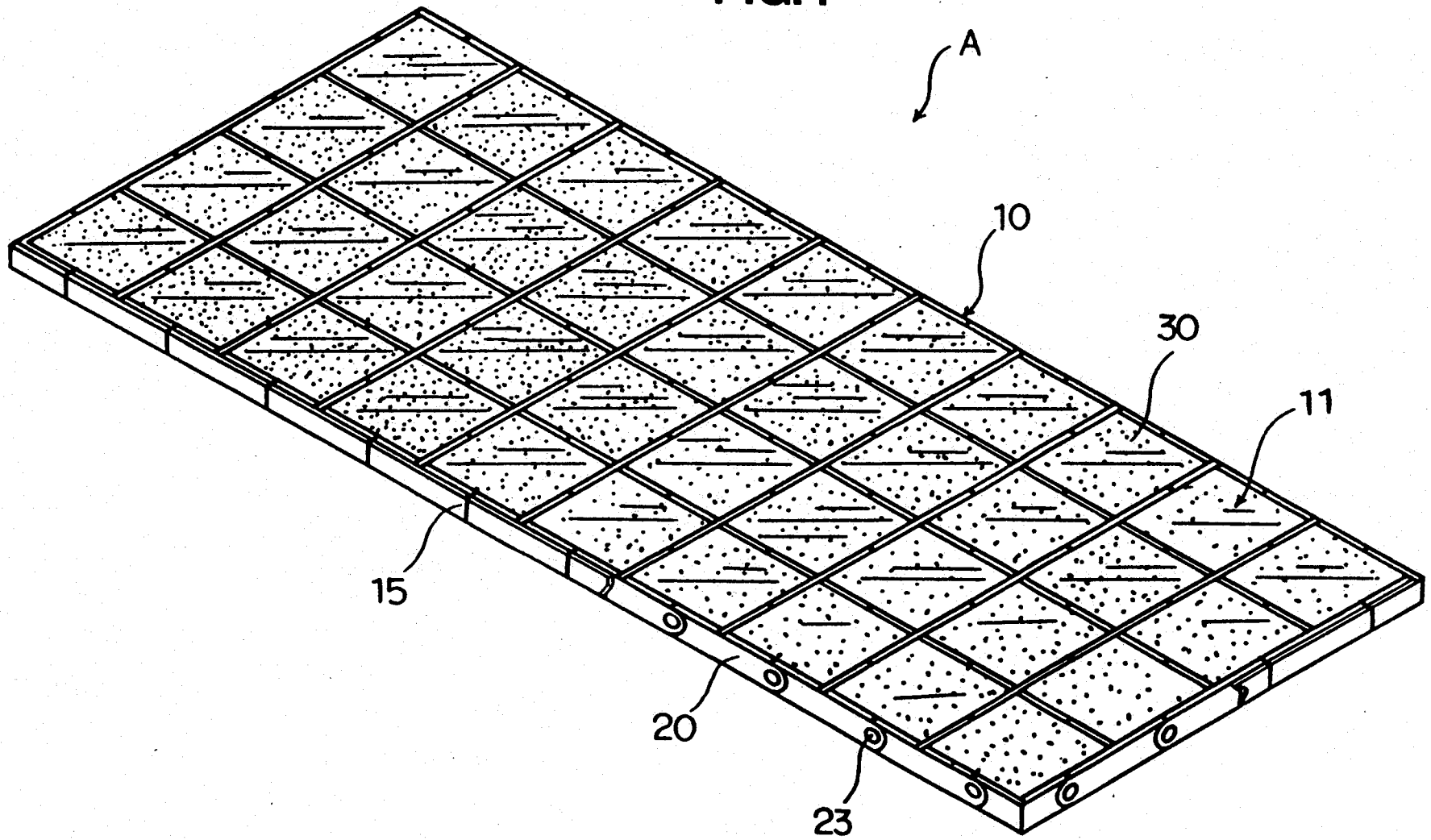
FIG. 1 is a perspective view of an embodiment of the stone-paved floor construction according to the present invention.

As illustrated in FIG. 1, the stone-paved floor construction A according to the invention is constituted by plurality of connector bars 20 which are linked with each other through pivotable joint portions 23 to provide a flexible frame structure 10, the connector bars 20 defining enclosures 11 to nest paving stone 30 therein.

Figure 2:
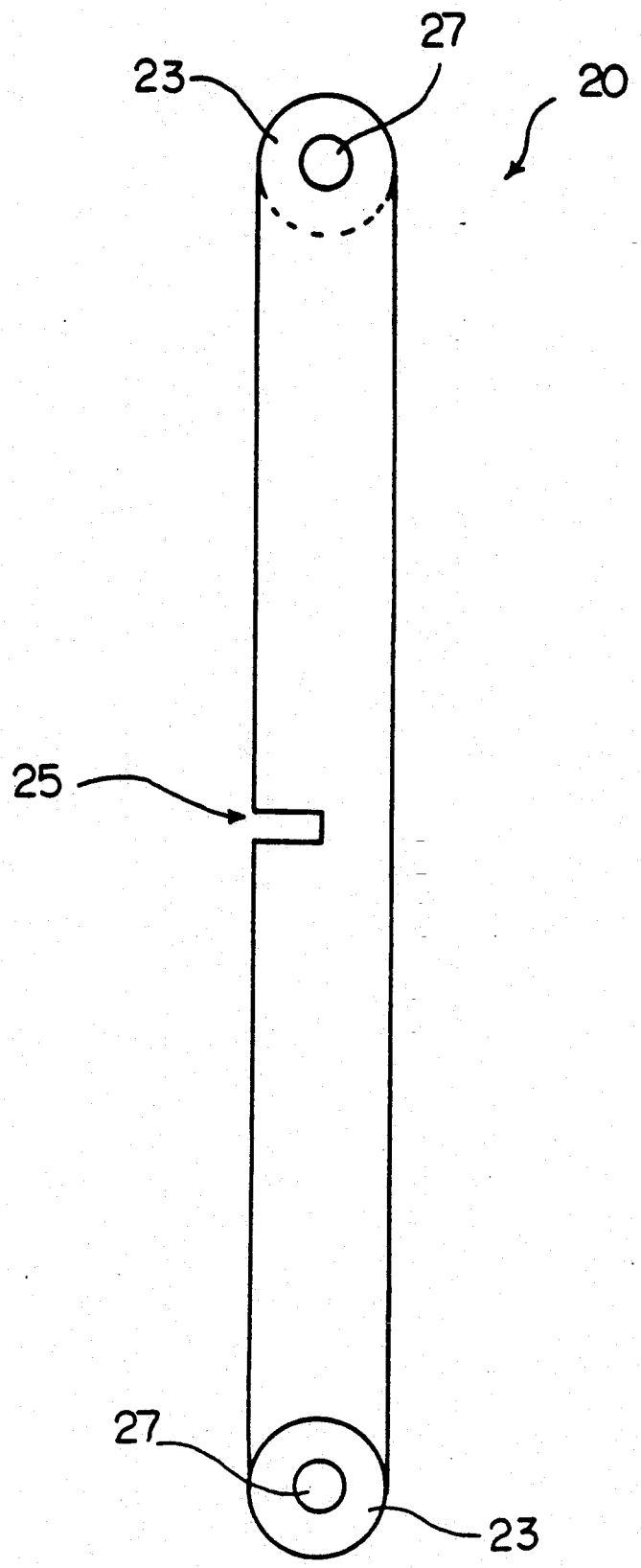
FIG. 2 is a plan view of a connector bar illustrated in the embodiment of FIG. 1.
Figure 3:
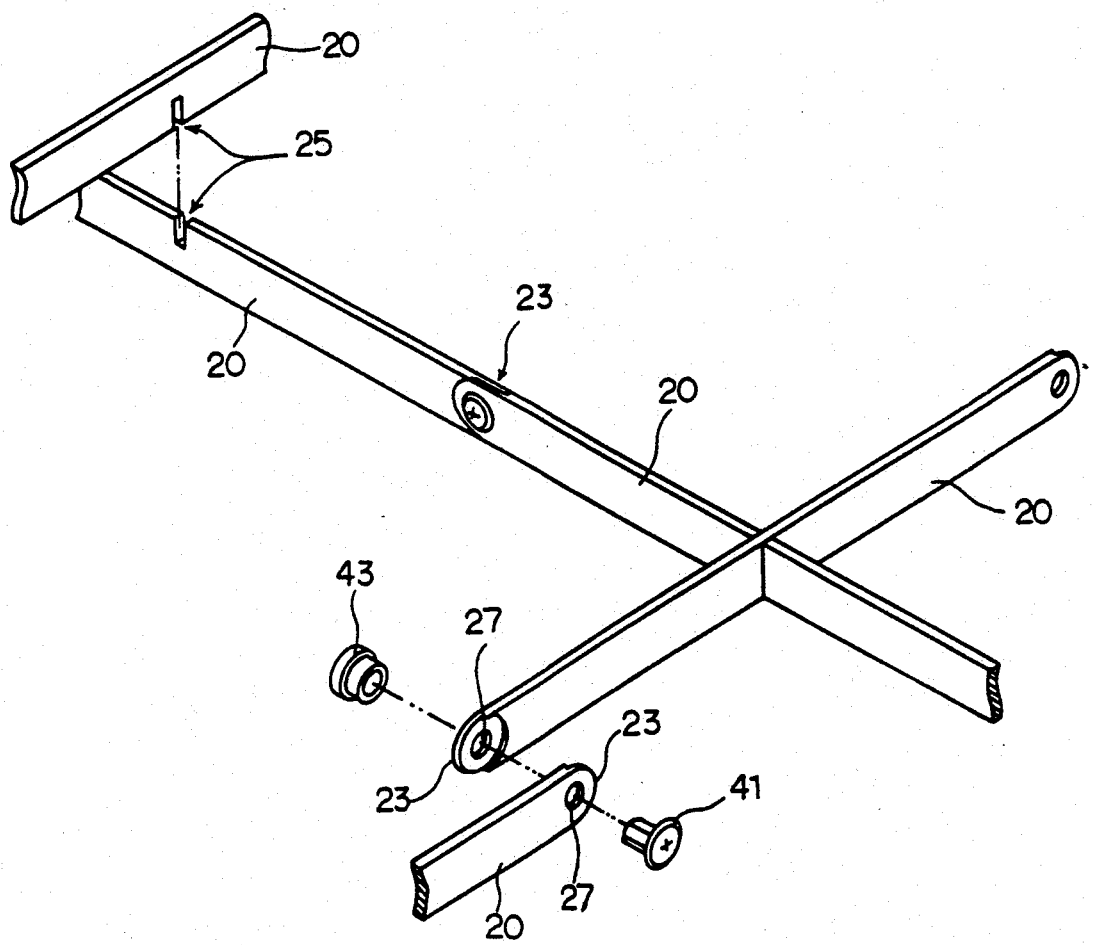
FIG. 3 is an exploded perspective view illustrating the manner of assembling a frame structure according to the present invention; and, FIG. 4 is an enlarged plan view of an enclosure according to the present invention.
Figure 4:
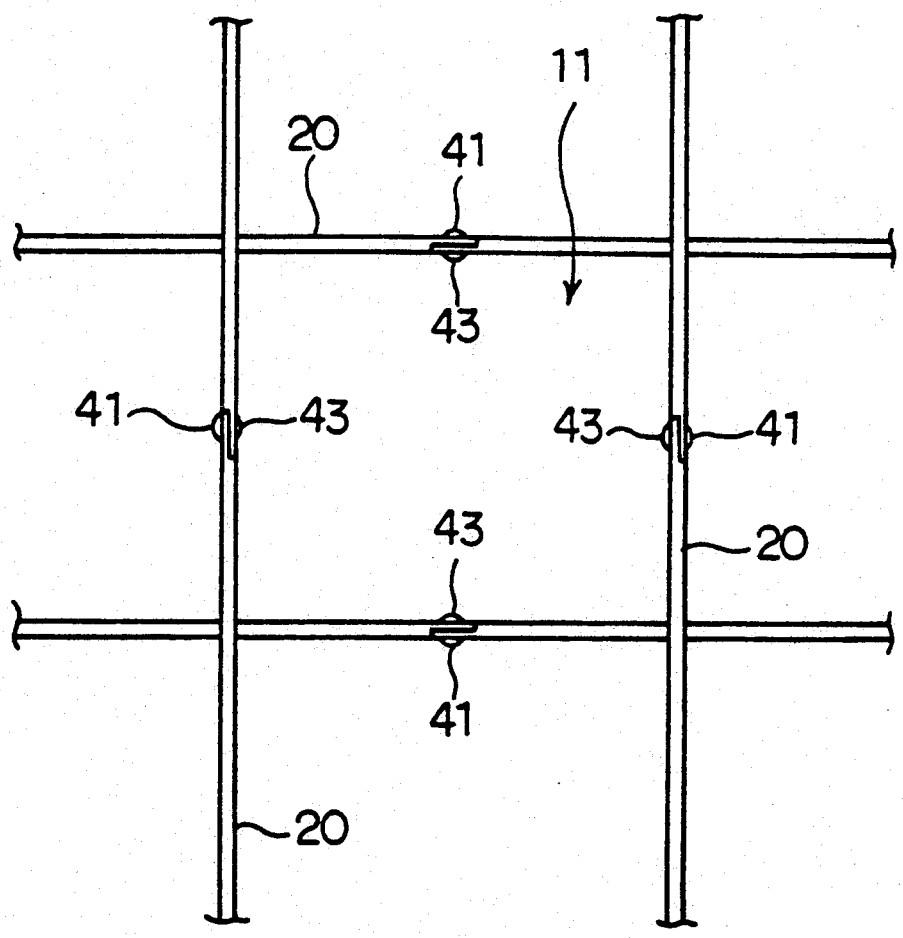

The connector bars 20 each consist of, for example, a bar of stainless steel in a thin and elongated form having a wall thickness of 1 mm to 2 mm and a length of 100 mm to 200 mm. and, as shown particularly in FIGS. 2 and 3, are each provided with a notched groove 25 at a center portion. Further, each connector bar 20 is provided with joint portions substantially of circular shape at the opposite ends thereof, and a through hole 27 is bored in each of the joint portions.

The notched groove 23 is provided for engagement with another connector bar 20, and has a depth which reaches a halfway point of the width of the connector bar 20.

On the other hand, the joint portions 23 are provided for joining or linking the connector bar 20 with other connector bars 20, and formed by cutting into the opposite end portions of the connector bar 20 substantially in a circular shape and to a depth corresponding to one half of the wall thickness of the connector bar 20 in an inverse direction relative to each other.

As shown in FIG. 3, the frame structure 10 is in the form of a reticular framework which is formed by coupling the connector bars 20 in crossed state through the respective notched grooves 25 and linking the joint portions 23 with joint portions 23 of other connector bars 20 by the use of male and female screws 41 and 43 of a thermoplastic resin material such as vinyl chloride, rubber or the like, which are coupled with each other through the joint holes 27.

The connector bars 20 to be located at the corners of the frame structure 10 are formed substantially in L-shape. The connector bars 2 to be located perpendicularly to the side surfaces of the frame structure 10 are halved in length as compared with other connector bars 20.

The connector bars 20 at the four sides of the frame structure 10 are fitted with cover members 15 of substantially U-shape in section thereby to conceal the joint portions 23 which might otherwise impair the aesthetic aspect of the appearance of the frame structure.

The enclosures 11, which are defined by the circumventing connector bars 20, are arranged to receive therein paving material 30 such as natural stone like marble stone, synthetic stone, or ceramic plates to be fitted in the frame 10.

The paving material 30 is supported by the male and female screws 41 and 43 at four different points, so that it is restrained of floating movements within the enclosures 11. Even if the respective pieces of the paving material 30 contain a certain degree of errors in dimension, they can be easily fitted in the enclosures 11 thanks to resilient or plastic deformation of the male and female screws 41 and 43.

Described below is a floor pavinq method using a stone-paved floor construction A according to the present invention.

In this paving method, the connector bars 20 are coupled with each other in crossed state at the respective center portions, and their joint portions 23 are pivotally linked to each other to form a reticular frame structure 10. This frame structure 10 is placed on a silencer material (not shown) which is spread on the floor surface, and then paving stone 30 is fitted in each of the enclosures 11 to make a stone-paved floor surface.

First, a silencer material such a nylon cloth, cotton cloth or the like is spread on the floor surface to be paved.

Second, the connector bars 20 are coupled with each other in crossed state on the silencer material, and linked to one another at the joint portions 23 (inserting male screws 41 into the through joint holes 27 and coupling the female screws 43 with the male screws 41 by the use of pinchers or the like) to form a frame structure 10, and the cover members 15 are fitted on side surfaces (except a side surface which is in abutting engagement with a wall surface).

Third, paving stone 30 is fitted into each enclosure 11 of the frame structure 10 by knocking same with a rubber hammer or the like to form a paved floor.

In this connection, it is to be understood that the stone-paved floor construction according to the present invention is also applicable, for example, to floors of new computerized buildings or elevators.

The present invention is not restricted to the above-described particular arrangements and procedures, and can be embodied in other forms as exemplified below.

For instance the connector bars 20 may be plated with aluminum or the like or provided with other surface treatment for the purpose of improving the aesthetic aspect of the appearance.

The enclosures 11 are basically formed in a square shape but may be formed in a trapezoidal shape by using angular connector bars 20 in combination with short connector bars 20 if desired. The connector bars 20 can also be arranged in a shape conforming with a floor with curved lines.

In carrying out the above floor paving method, it is possible to assemble a frame structure elsewhere and to transport the assembled frame structure to a construction site for installation.

It is also possible to employ a silencer material which bears on its surface a print of design drawing for colors and lines of a picture or pattern to be reproduced by the floor paving, in combination with connector bars 20 of extremely small lengths to form very small enclosures as required by the picture or pattern. In this case, a desired picture or pattern can be reproduced on the floor surface by successively fitting paving stones of various colors in the enclosures 11 according to the design drawing on the silencer material.

The stone-paved floor construction and floor paving method of the present invention have the following effects.

(1) The present invention permits even an inexperienced worker to perform the floor paving job easily, speedily and neatly in such a manner as to improve the working efficiency and to reduce the paving cost, while contributing to solving the problem of the deficient number of skilled workers like masons.

(2) According to the present invention, the paving stones are respectively fitted in enclosures 11, so that in the event of fracture of a single piece of paving stone, the floor can be reformed simply by replacing the fractured paving stone by a new one.

(3) At the time of reforming a floor surface, the stone-paved floor construction of the present invention can be installed on the existing floor surface without crushing and removing old paving stones.

(4) The frame structure is constituted of a plurality of pivotally linked connector bars, so that, when it is placed on a floor surface with undulations or irregularities, it is flexed at its pivotable joints to bring the respective connector bars in abutting engagement with the floor surface to preclude their floating movements.

(5) The frame structure of the above construction can be coiled into a roll by flexing the respective connector bars at the pivotable joints, and can be easily transported in an assembled state.

(6) The paving stones, which are each supported by screws at four different points, are restrained of free movements within the enclosures, and can be snugly fitted into the enclosures by resilient or elastic deformations of screws which suitably absorb dimensional errors of paving stones, if any.

(7) According to the present invention, a tile or other paving material can be installed on a floor simply by placing it on a floor surface instead of fixedly bonding it to the latter. It follows that the paving material can be laid directly on a floor surface with a heater and can contribute to the improvement of heating effects.

What is claimed is:

1. A stone-paved floor construction, comprising a plurality of connector bars having apertures on opposite ends thereof adapted to receive a screw for joining said connector bars, thereby providing substantially rotatable joints, said connector bars being linked to one another by said rotatable joints to form a flexible frame structure having a plurality of enclosures therein; and paving stones fitted in said enclosures circumvented by said joined connector bars to form a stone-paved floor surface.

2. The stone-paved floor of claim 1, wherein the connector bars are stainless steel.

3. The stone-paved floor of claim 2, where the connector bars have a wall thickness of from 1 to 2 mm and a length of from 100 to 200 mm.

4. The stone-paved floor of claim 1, wherein the connector bars have a notched groove at a center portion thereof.

5. The stone-paved floor of claim 1, wherein the connector bars have a joint portion of substantially circular shape with an aperture in each of said joint portions adapted to receive a screw.

6. A method of paving a floor with stones, comprising: providing a plurality of connector bars, coupling said connector bars in a crossed configuration at center portions thereof; said connector bars having apertures on opposite ends thereof adapted to receive a screw for joining said connector bars to form rotatable joints joining said connector bars to one another by inserting a screw in said apertures and forming rotatable joints at ends thereof forming a frame structure on a floor surface said frame structure defining a plurality of enclosure; and placing paving stones in said enclosures.

* * * * *